US007555133B2

(12) United States Patent
Hama

(10) Patent No.: US 7,555,133 B2
(45) Date of Patent: Jun. 30, 2009

(54) ELECTRO-ACOUSTIC TRANSDUCER

(75) Inventor: Yoshinori Hama, Tokyo (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 11/892,746

(22) Filed: Aug. 27, 2007

(65) Prior Publication Data

US 2008/0056515 A1 Mar. 6, 2008

(30) Foreign Application Priority Data

Aug. 30, 2006 (JP) ..... 2006-233419

(51) Int. Cl.
*H04R 25/00* (2006.01)

(52) U.S. Cl. ..... 381/190; 381/152; 381/186

(58) Field of Classification Search ..... 381/152, 381/337, 114, 173, 190, 191, 398, 431, 186; 310/330–332; 367/157, 160, 162, 165; 181/157, 181/161

See application file for complete search history.

(56) References Cited

U.S. PATENT DOCUMENTS

| | | | | |
|---|---|---|---|---|
| 6,865,277 | B2 * | 3/2005 | Bank et al. | 381/152 |
| 7,180,225 | B2 * | 2/2007 | Sashida et al. | 310/330 |
| 7,247,976 | B2 * | 7/2007 | Sashida et al. | 310/330 |

FOREIGN PATENT DOCUMENTS

| | | |
|---|---|---|
| JP | 62-176399 | 8/1987 |
| JP | 5-219588 | 8/1993 |

* cited by examiner

*Primary Examiner*—Huyen D Le
(74) *Attorney, Agent, or Firm*—McGinn IP Law Group, PLLC

(57) ABSTRACT

An electro-acoustic transducer includes a first electro-acoustic transduction unit. The first electro-acoustic transduction unit includes an acoustic radiation plate which radiates a sound wave, a bending vibration plate including a vibrator, and a first coupling member which couples an edge portion of the acoustic radiation plate with an edge portion of the bending vibration plate together.

17 Claims, 7 Drawing Sheets

ELECTRO-ACOUSTIC TRANSDUCER

RELATED APPLICATIONS

This application is based on Japanese Patent Application No. JP2006-233419 filed on Aug. 30, 2006, and including a specification, claims, drawings and summary. The disclosure of the above Japanese Patent Application is incorporated herein by reference in its entirety.

BACKGROUND OF THE INVENTION

1. Field of the Invention

The present invention relates to an electro-acoustic transducer and, in particular, relates to an electro-acoustic transducer which radiates a sound wave into a medium such as water.

2. Description of the Related Art

An electro-acoustic transducer which radiates a sound wave into a medium such as water is installed, for example, in a transmitter of sonar used for a marine resource search, an ocean current investigation or the like. Since a sound wave in a low frequency band can be propagated long-range in the water, the electro-acoustic transducer capable to radiate the sound wave in the low frequency band is requested. Moreover, since the electro-acoustic transducer is usually installed in a ship or an airplane, a small-sized electro-acoustic transducer with the high power efficiency is requested.

In order to cope with the above mentioned requests, the electro-acoustic transducers of various structures have been proposed. For example, Japanese Patent Application Publication No. 62-176399 discloses a bolted Langevin type electro-acoustic transducer in which a pillar-shaped vibrator including laminated piezoelectric ceramic plate is interposed between a front mass and a rear mass, and the front mass and the rear mass are fastened with a bolt. The electro-acoustic transducer radiates a sound wave in a medium in a longitudinal vibration mode. Since an electro-mechanical coupling coefficient of the longitudinal vibration mode is relatively large, the electro-acoustic transducer can radiate a strong sound wave from the front mass.

JP05-219588 A discloses an electro-acoustic transducer having an acoustic radiation plate in which a vibrator including a piezoelectric ceramics or the like is arranged. The electro-acoustic transducer radiates a sound wave in a bending vibration mode in a medium. Since a resonance frequency of the bending vibration mode is lower than a resonance frequency of the longitudinal vibration mode, this type of the electro-acoustic transducer can lower a frequency of the output sound wave. Moreover, a ratio of a sound radiation area to a total apparatus surface area in the electro-acoustic transducer is higher than that of the electro-acoustic transducer disclosed in JP62-176399 A. Accordingly, the electro-acoustic transducer disclosed in JP05-219588 A can be smaller and lighter than the electro-acoustic transducer disclosed in JP62-176399 A.

In general, the lowest frequency which can be output by an electro-acoustic transducer depends on the lowest resonance frequency of a vibration plate. A resonance frequency of a longitudinal vibration mode depends on weights of a front mass and a rear mass, and depends on stiffness of a pillar-shaped vibrator. Accordingly, in order to lower an output frequency of the electro-acoustic transducer in the longitudinal vibration mode, it is necessary to weight the front mass and the rear mass or to lengthen the pillar-shaped vibrator. That is, the electro-acoustic transducer disclosed in JP62-176399 A cannot cope with both lowering the output sound wave frequency and reducing a size and weight thereof.

The electro-acoustic transducer disclosed in JP05-219588 A adopts a structure in which the vibrator is directly installed in the acoustic radiation plate, and the acoustic radiation plates are fixed at the edge portions thereof. In the acoustic radiation plate, the edge portion acts as a node of the vibration. Vibration amplitude of the acoustic radiation plate may be large at a central portion, but is quite small or almost zero at the vicinity of the fixed portion. Since the excluded medium volume is corresponding to the vibration amplitude of the acoustic radiation plate, the electro-acoustic transducer disclosed in JP05-219588 A has low electro-acoustic transduction efficiency. Since the heavy vibrator is directly installed in the acoustic radiation plate in case of the electro-acoustic transducer disclosed in JP05-219588 A, weight of the acoustic radiation plate increases. Due to the heavy acoustic radiation plate, a resonance frequency bandwidth of the acoustic radiation plate in the bending vibration mode becomes very narrow. Accordingly, the electro-acoustic transducer disclosed in JP05-219588 A can not radiate a broadband sound wave.

SUMMARY OF THE INVENTION

The present invention has been made in order to settle the above mentioned problems. The object of the present invention is to provide an electro-acoustic transducer which has a small size and light weight, can radiate a sound wave in a low frequency band and has the high electro-acoustic transduction efficiency.

In an exemplary aspect of the present invention, an electro-acoustic transducer includes a first electro-acoustic transduction unit. The first electro-acoustic transduction unit includes an acoustic radiation plate which radiates a sound wave, a bending vibration plate including a vibrator, and a first coupling member which couples an edge portion of the acoustic radiation plate with an edge portion of the bending vibration plate together.

The electro-acoustic transducer can be made small and light, can radiate the sound wave in a low frequency band, and can improve the electro-acoustic transduction efficiency.

Other exemplary features and advantages of the present invention will be apparent from the following description taken in conjunction with the accompanying drawings, in which like reference characters designate the same or similar parts throughout the figures thereof.

BRIEF DESCRIPTION OF THE DRAWINGS

Exemplary features and advantages of the present invention will become apparent from the following detailed description when taken with the accompanying drawings in which.

DETAILED DESCRIPTION OF THE EXEMPLARY EMBODIMENT

Figure 1A:
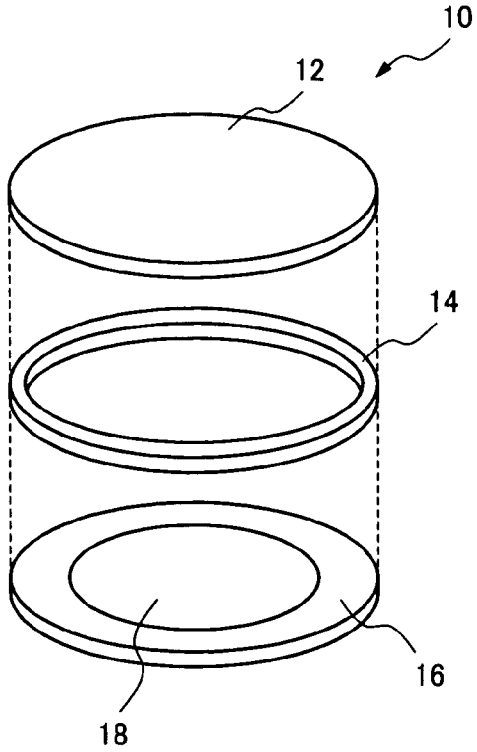
FIG. 1A shows an example of an exploded perspective view of an electro-acoustic transducer according to a first embodiment of the present invention.
Figure 1B:
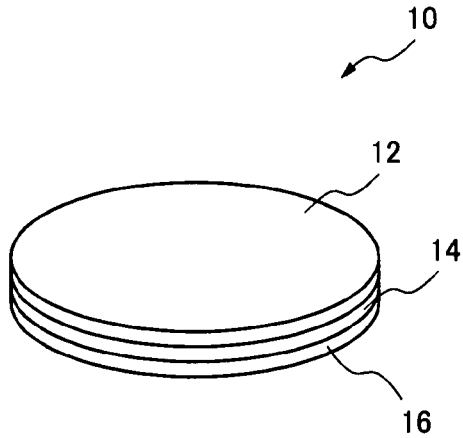
FIG. 1B shows an example of a perspective view of the electro-acoustic transducer shown in FIG. 1A.
Figure 1C:
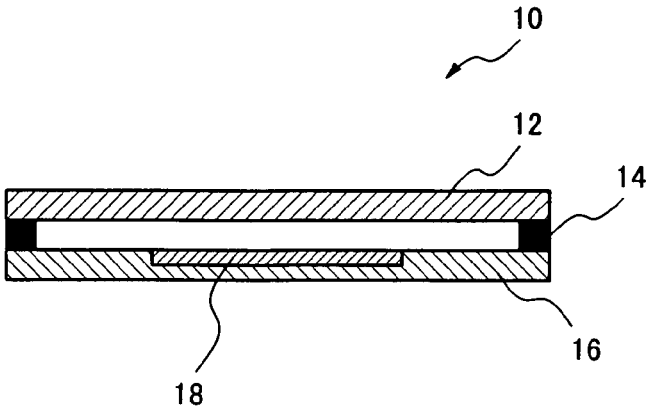
FIG. 1C shows an example of a cross section of the electro-acoustic transducer shown in FIG. 1A.

Hereinafter, exemplary embodiments of the present invention will be described in detail with reference to drawings. FIG. 1A shows an exploded perspective view of an electro-acoustic transducer 10 according to a first exemplary embodiment of the present invention. FIG. 1B shows a perspective view of the electro-acoustic transducer 10 of the embodiment and FIG. 1C shows a cross section of the electro-acoustic transducer 10 thereof.

The electro-acoustic transducer 10 includes a disk type acoustic radiation plate 12 and a disk type bending vibration plate 16. The disk type acoustic radiation plate 12 and the disk type bending vibration plate 16 are connected to each other, at edge portions thereof, via a first annular coupling member 14. The acoustic radiation plate 12 radiates a sound wave in a medium such as water. The bending vibration plate 16 includes a disk type vibrator 18 in the central part thereof. In general, the vibrator 18 is heavy. Therefore, when the bending vibration plate 16 includes the vibrator 18, the acoustic radiation plate 12 without the vibrator 18 becomes lightweight. The lightened acoustic radiation plate 12 may radiate a broadband sound wave. In this case, the acoustic radiation plate 12 may be made of a substance with high stiffness, such as metal like iron or aluminum. The bending vibration plate 16 is made of a substance which is not elastic, for example, aluminum or the like. The vibrator 18 vibrates in a radial direction in response to an applied voltage. For example, the vibrator 18 can be made of an electrostriction material such as piezoelectric ceramics, or a magnetostriction member. The ratio of a diameter of the bending vibration plate 16 to one of the vibrator 18 is determined appropriately. Further, since the electro-acoustic transducer 10 is shielded by a shield member (not shown), all the elements above-mentioned are insulated from a medium such as surrounding water or the like.

Figure 2:
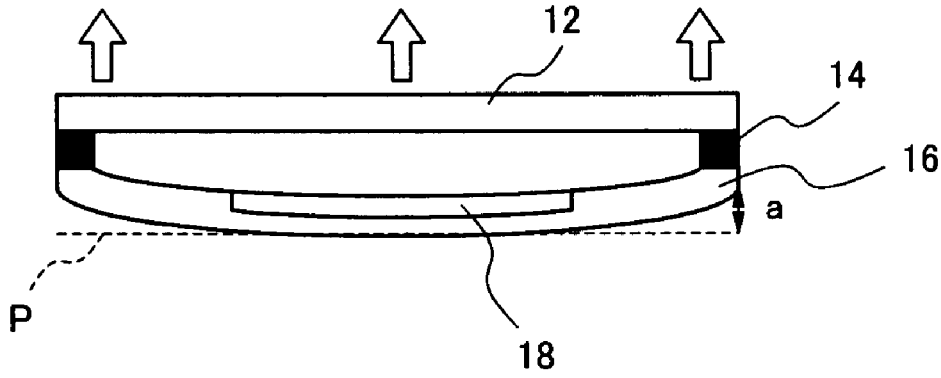
FIG. 2 shows each displacement state of a bending vibration plate and an acoustic radiation plate of the electro-acoustic transducer shown in FIG. 1A to 1C.

Operations of the electro-acoustic transducer 10 will be described. FIG. 2 shows one of positions of the bending vibration plate 16 and the acoustic radiation plate 12 in the electro-acoustic transducer 10 during vibration. The vibrator 18 vibrates in a radial direction in response to an applied voltage. Corresponding to the radial directional vibration, the bending vibration plate 16 vibrates in a bending manner. In FIG. 2, "a" represents amount of displacement, due to the bending vibration, of the bending vibration plate 16. The acoustic radiation plate 12 moves forward and backward, by the displacing distance "a", corresponding to the bending vibration. Due to the displacement, a sound wave is radiated in a medium such as water. In this case, a medium volume excluded by the electro-acoustic transducer 10 is the product of the displacing distance "a" of the bending vibration plate 16 and an area of the acoustic radiation plate 12. The medium volume excluded by the acoustic radiation plate 12 above-mentioned is larger than the medium volume excluded by a bending vibration thereof. Accordingly, the electro-acoustic transducer 10 may improve the electro-acoustic transduction efficiency.

The electro-acoustic transducer 10 sends the sound wave into the medium by the bending vibration. Because a resonance frequency of the bending vibration is lower than that of the longitudinal vibration, it is possible to lower an output sound wave frequency of the electro-acoustic transducer 10. Moreover, since a ratio of a surface area from which the sound wave is sent to a total surface area in the electro-acoustic transducer 10 is higher than the ratio in an electro-acoustic transducer for vibrating in a longitudinal vibration mode, the electro-acoustic transducer 10 can reduce a size and a weight thereof.

Figure 3:
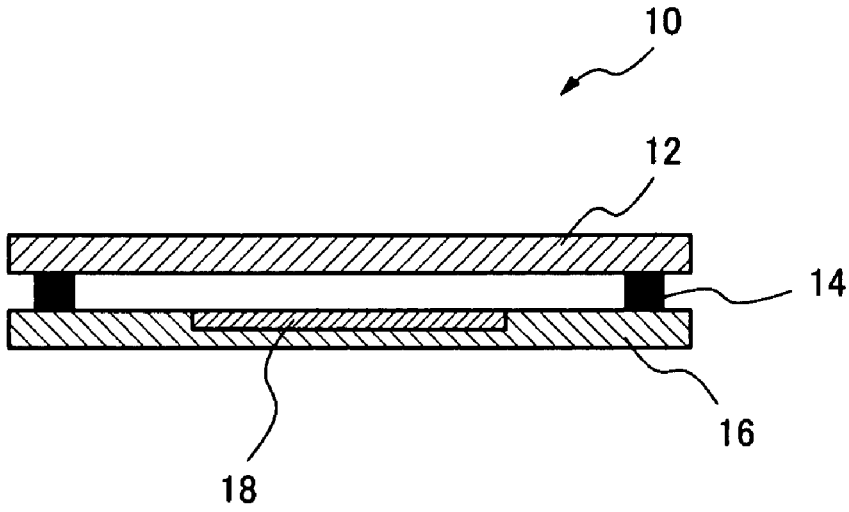
FIG. 3 shows a cross section of the electro-acoustic transducer in the case that the slightly inner edge portion in comparison with the outmost edge portion of the acoustic radiation plate and the bending vibration plate are coupled each other by a first coupling member.

FIG. 3 shows a cross section of the electro-acoustic transducer 10 in which the first annular coupling member 14 is arranged at slightly inside position from edge region of the acoustic radiation plate 12 and the bending vibration plate 16. The electro-acoustic transducer 10 having such configuration may advantageously operate.

Figure 4:
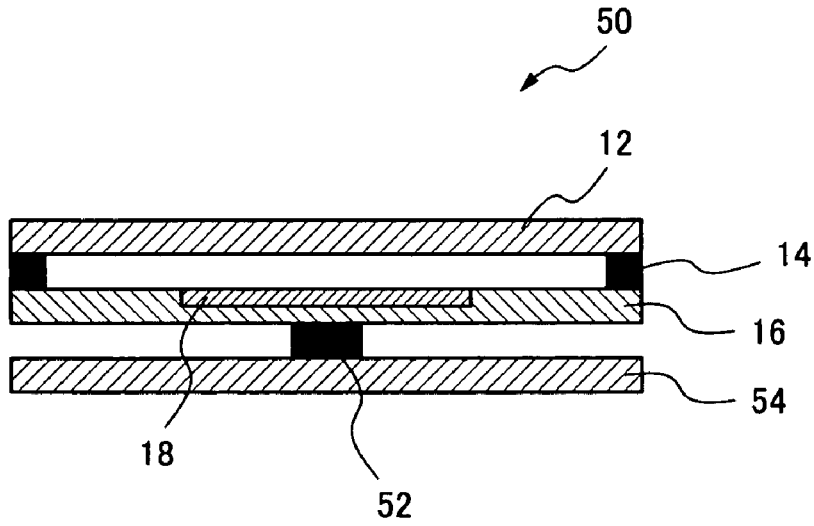
FIG. 4 shows an example of a cross section of an electro-acoustic transducer according to a second embodiment of the present invention.

FIG. 4 shows a cross section of an electro-acoustic transducer 50 according to a second exemplary embodiment of the present invention. The electro-acoustic transducer 50 includes a second coupling member 52 which couples a central portion of the bending vibration plate 16 to a supporting plate 54. When the central portion of the bending vibration plate 16 is fixed, a direction of the acoustic radiation can be set in a vertical direction to the supporting plate 54.

Figure 5:
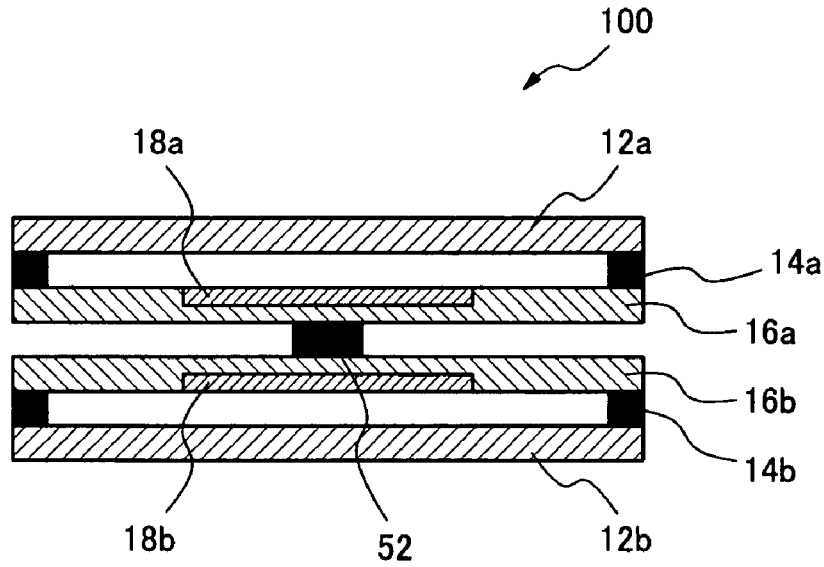
FIG. 5 shows an example of a cross section of an electro-acoustic transducer according to a third embodiment of the present invention.

FIG. 5 shows a cross section of an electro-acoustic transducer 100 according to a third exemplary embodiment of the present invention. The electro-acoustic transducer 100 has a pair of acoustic radiation plates 12*a* and 12*b* which are arranged oppositely each other. The acoustic radiation plates 12*a* and 12*b* are coupled to bending vibration plates 16*a* and 16*b* by first coupling members 14*a* and 14*b* respectively. The bending vibration plates 16*a* and 16*b* have vibrators 18*a* and 18*b* respectively. The central portions of the bending vibration plates 16*a* and 16*b* are coupled each other by the second coupling member 52. Since a pair of the bending vibration plates 16*a* and 16*b* has a symmetrical structure whose center of symmetry is located in the second coupling member 52, vibrations of the bending vibration plates 16*a* and 16*b* are properly balanced.

Figure 6:
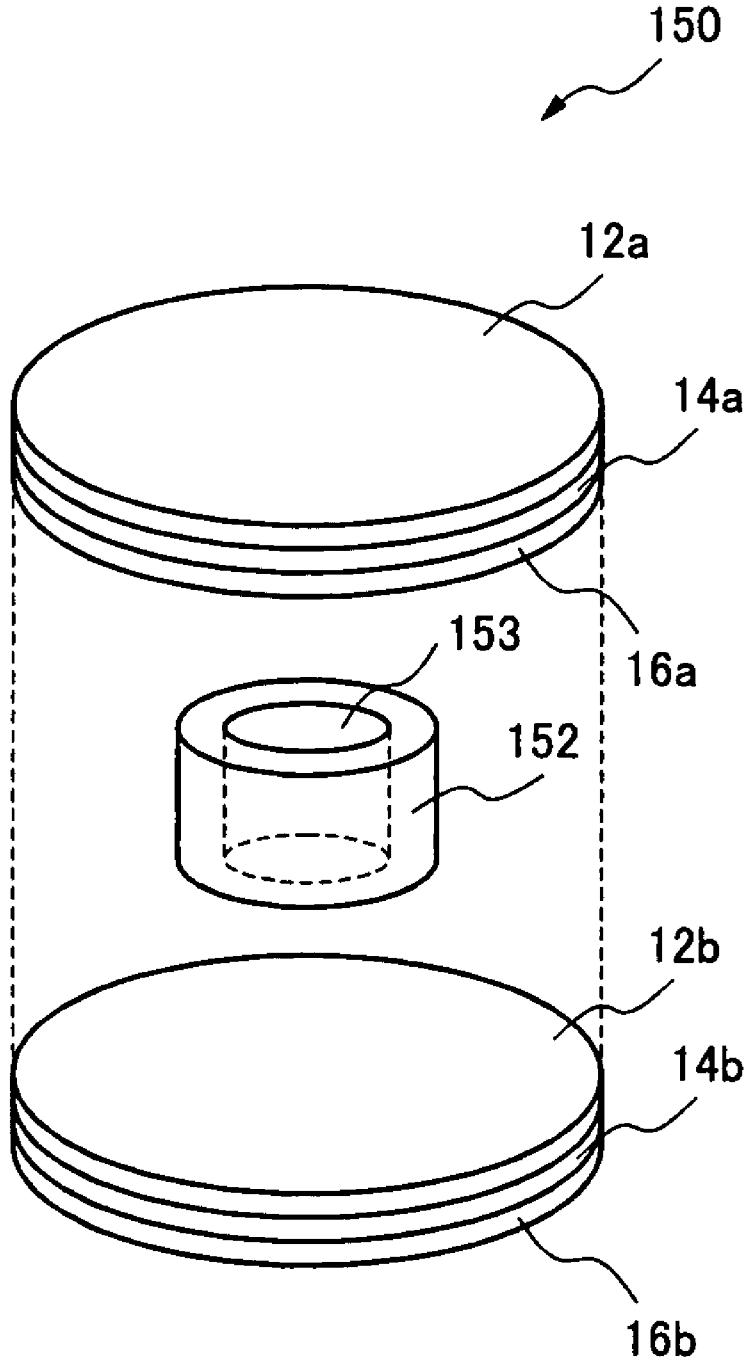
FIG. 6 shows an example of a an exploded perspective view of an electro-acoustic transducer according to a fourth embodiment of the present invention.

FIG. 6 shows an example of an exploded perspective view of an electro-acoustic transducer 150 according to a fourth exemplary embodiment of the present invention. In the electro-acoustic transducer 150, a cavity 153 is formed inside a second coupling member 152. One or more components in relation to the electro-acoustic transducer 150, for example, a matching transformer which drives a vibrator or the like may be installed in the cavity 153. Accordingly, it is possible to make the electro-acoustic transducer 150 small further. When a predetermined concave part or a through hole are formed at a position corresponding to the cavity 153 of the bending vibration plates 16*a* and 16*b*, the cavity can be made wide further.

Figure 7:
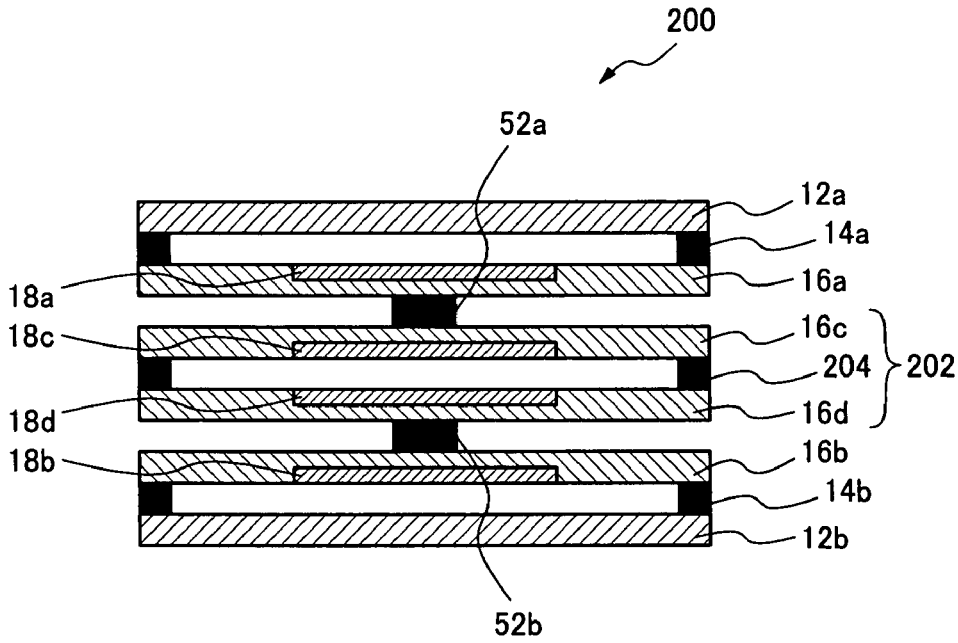
FIG. 7 shows an example of a cross section of an electro-acoustic transducer according to a fifth embodiment of the present invention.

FIG. 7 shows an example of a cross section of an electro-acoustic transducer 200 according to a fifth exemplary embodiment of the present invention. The electro-acoustic transducer 200 includes a bending vibration plate unit 202. The bending vibration plate unit 202 is arranged between a pair of the acoustic radiation plates 12*a* and 12*b* which are arranged oppositely each other. The bending vibration plate unit 202 includes bending vibration plates 16*c* and 16*d*. The bending vibration plates 16*c* and 16*d* include vibrators 18*c* and 18*d* respectively. The edge portions of the bending vibration plates 16*c* and 16*d* are coupled by a third coupling member 204. The bending vibration plate 16*c* and the bending vibration plate 16*a* are coupled by a second coupling member 52*a* at their central positions. The bending vibration plate 16*d* and the bending vibration plate 16*b* are coupled by a second coupling member 52*b* at their central positions. When the bending vibration plates 16*c* and 16*d* are disposed between a pair of the acoustic radiation plates 12*a* and 12*b*, displacement of the acoustic radiation plates 12*a* and 12*b* may be increased. The predetermined voltage with the predetermined polarity is applied to each of the vibrators 18*a*, 18*b*, 18*c*, and 18*d*. Each of the vibrators 18*a*, 18*b*, 18*c*, and 18*d* is displaced in the radial direction in response to the applied voltage. Based on the radial direction displacement, the bending vibration plates 16*a*, 16*b*, 16*c*, and 16*d* perform bending vibrations. Then, the acoustic radiation plates 12*a* and 12*b* move forward and backward based on the bending displacement of the bending vibration plates 16*a* to 16*d*. The movements of the acoustic radiation plates 12*a* and 12*b* radiate sound waves into a medium such as water.

Figure 8:
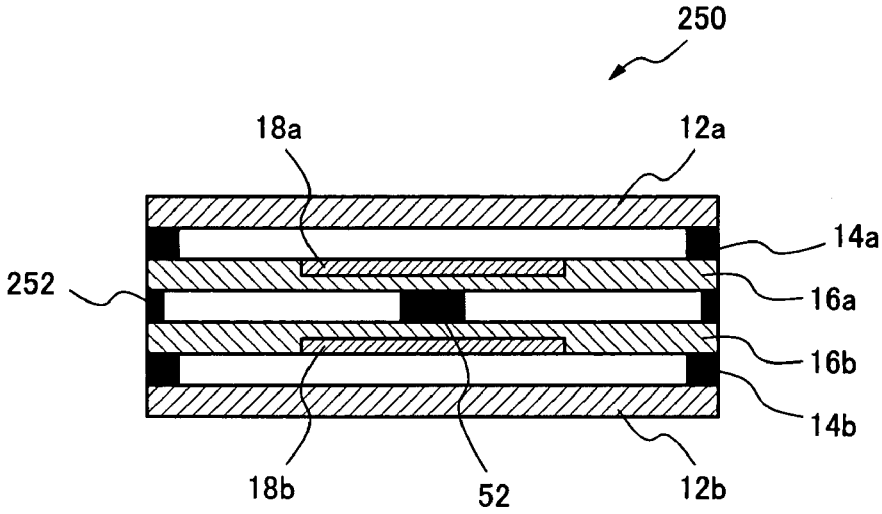
FIG. 8 shows an example of a cross section of an electro-acoustic transducer according to a sixth embodiment of the present invention.

FIG. 8 shows an example of a cross section of an electro-acoustic transducer 250 according to a sixth exemplary embodiment of the present invention. In the electro-acoustic transducer 250, a gap between edge portions of the bending vibration plates 16*a* and 16*b* are sealed over the whole area thereof by a seal member 252. Because the seal member 252 prevents a medium from flowing into a space which is formed by a pair of the bending vibration plates 16*a* and 16*b*, the space can be used as an air chamber. Therefore, vibrations of the bending vibration plates 16*a* and 16*b* are not influenced by a medium. In such configuration, an excluded medium volume by the acoustic radiation plates 12*a* and 12*b* does not always decrease. By use of the seal member 252, the electro-acoustic transducer 250 can be arranged directly in water without any shield member which covers a whole surface of the transducer 250. The seal member 252 may be elastic material such as rubber and a resin.

Figure 9:
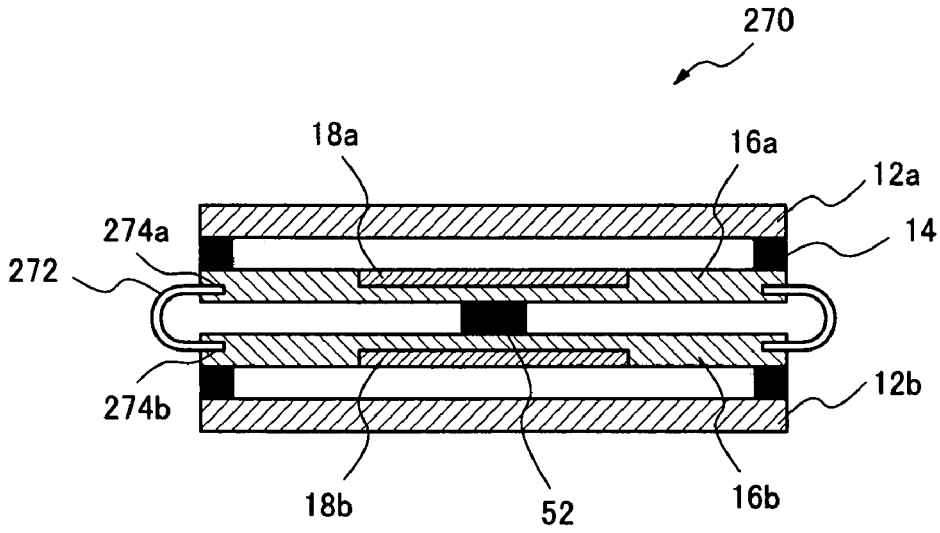
FIG. 9 shows an example of a cross section of an electro-acoustic transducer according to a seventh embodiment of the present invention.

FIG. 9 shows an example of a cross section of an electro-acoustic transducer 270 according to a seventh exemplary embodiment of the present invention. In the electro-acoustic transducer 270, a gap between edge portions of the bending vibration plates 16*a* and 16*b* is sealed by a thin metal plate 272 of which cross section is a U-shaped form. Both ends of the metal plate 272 are fit in slots 274*a* and 274*b* respectively which are formed in the edge portions of the bending vibration plates 16*a* and 16*b* respectively. When thickness of the metal plate 272 is adjusted so that vibrations of the bending vibration plates 16*a* and 16*b* should not be influenced, a excluded medium volume by the acoustic radiation plates 12*a* and 12*b* does not decreases. Moreover, the metal plate 272 has moderate stiffness in comparison with rubber or the like. Therefore, in case that the metal plate 272 is displaced by the bending vibration plates 16*a* and 16*b* approaching each other, the displacement of the metal plate 272 causes excluding a medium. That is, when the metal plate 272 seals the cavity which is formed between a pair of the bending vibration plates 16*a* and 16*b*, it becomes possible to increase a excluded medium volume further.

Figure 10:
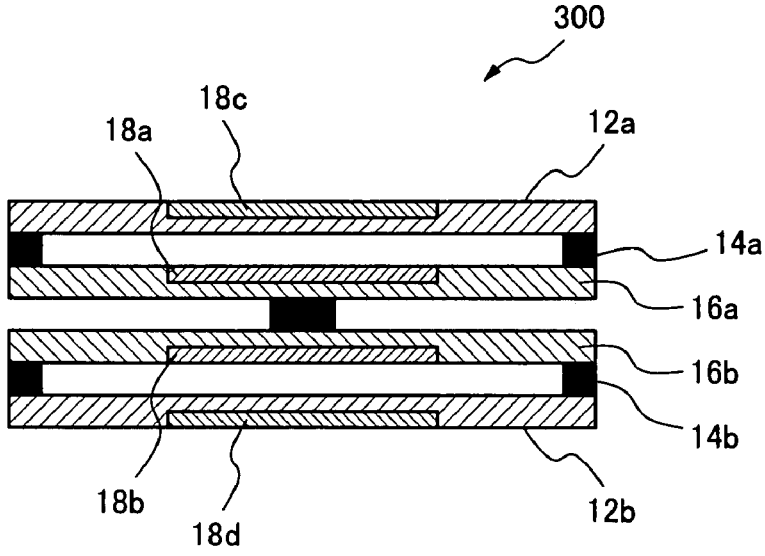
FIG. 10 shows an example of a cross section of an electro-acoustic transducer according to a eighth embodiment of the present invention.

FIG. 10 shows an example of a cross section of an electro-acoustic transducer 300 according to an eighth exemplary embodiment of the present invention. In the electro-acoustic transducer 300, acoustic radiation plates 12*a* and 12*b* include vibrators 18*c* and 18*d* respectively. The acoustic radiation plates 12*a* and 12*b* move forward and backward based on vibrations of bending vibration plates 16*a* and 16*b* and, moreover, move based on bending vibrations of the vibrators 18*c* and 18*d*. If thickness, diameter, material, or the like of the acoustic radiation plates 12*a* and 12*b* are appropriately adjusted, it is possible to adjust appropriately both resonance frequency of the acoustic radiation plates 12*a* and 12*b* in a bending vibration mode and resonance frequencies of the bending vibration plates 16*a* and 16*b*. For example, if the above resonance frequencies are set equal, the bending vibrations are advantageously superposed. That is, a excluded medium volume can be made large further, because the displacement of the radiation plates 12*a* and 12*b* become large further. For another example, when the resonance frequencies are slightly different each other, a broadband sound wave can be radiated.

Figure 11:
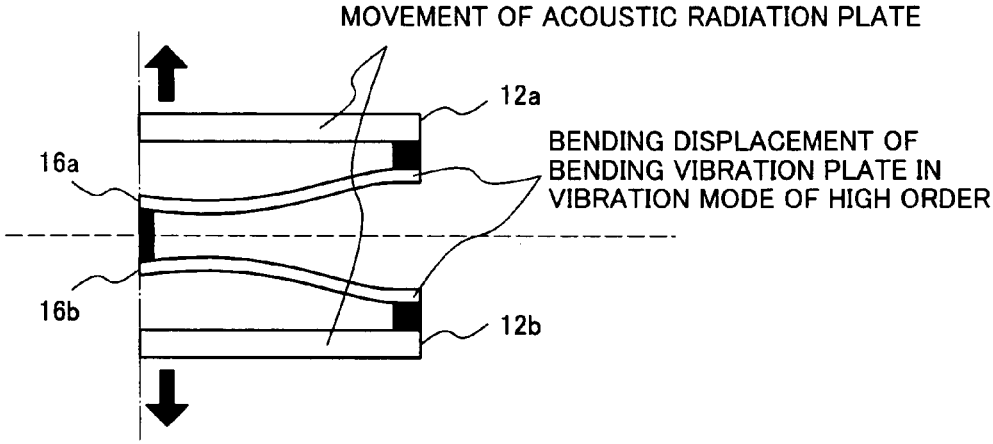
FIG. 11 shows a displacement of the bending vibration plate when the bending vibration plate is vibrated in a vibration mode of a high order (for example, beyond second order)

FIG. 11 shows, displacements of the bending vibration plates 16*a* and 16*b* which vibrated in the high order bending vibration mode higher than a fundamental bending vibration mode. When thickness and diameter of the bending vibration plates 16*a* and 16*b* are appropriately adjusted, it is possible to vibrate the bending vibration plates 16*a* and 16*b* in the high order bending vibration mode. For example, in the second order bending vibration mode, a vibration direction near center portions and a vibration direction near outside portions in the bending vibration plates 16*a* and 16*b* are reversed each other. An excluded medium volume can be calculated through integrating the displacement per infinitesimal area of the bending vibration plates 16*a* and 16*b* through the whole vibration plate of the bending vibration plates 16*a* and 16*b*. By vibrating the bending vibration plates 16*a* and 16*b* in the high order bending vibration mode, fluctuation of the excluded medium volume which is generated near the central portions and near the outside portions of the bending vibration plates 16*a* and 16*b* can be cancelled totally. Moreover, reaction force which a medium applies to the inside portion of the bending vibration plates 16*a* and 16*b* is reduced substantially. Accordingly, it is possible to improve driving efficiency of the bending vibration plates 16*a* and 16*b*. It is possible to avoid the harmful influence on medium exclusion by the acoustic radiation plates 12*a* and 12*b*, which is caused by a medium existing between the bending vibration plates 16*a* and 16*b*. Since it is avoided that the excluded medium volume by the acoustic radiation plates 12*a* and 12*b* is sucked by the bending vibration plates 16*a* and 16*b*, it is possible to prevent the electro-acoustic transduction efficiency from degrading.

The above mentioned various coupling members, for example, the first coupling member 14 and the second coupling member 52 can be integrated into the acoustic radiation plate 12 and the bending vibration plate 16. The integration, for example, can reduce the number of parts. Further, it is not necessary for the whole edge portions of the acoustic radiation plate 12 and the bending vibration plate 16 to be coupled each other. That is, the first coupling member 14 may couple partially the edge portions of the acoustic radiation plate 12 and the bending vibration plate 16 together.

The first coupling member 14 and the second coupling member 52 may include a mechanism to restrain a stress concentration, for example, a hinge and a universal joint. By the above mentioned coupling members including the mechanism for restraining the stress concentration, the acoustic radiation plate 12 and the bending vibration plate 16 can vibrate in the vibration mode with the restrained stress concentration, in spite of their restricted positions. By the vibration in the above mentioned vibrating mode, it is possible to suppress the increase of the resonance frequencies and the decrease of the bending displacements with regard to the acoustic radiation plate 12 and the bending vibration plate 16.

The bending vibration plate 16 may adopt the so-called unimorph structure in which the vibrator 18 is installed in either of surfaces of the bending vibration plate 16, and may adopt the bimorph structure in which the vibrators 18 are installed in both surfaces of the bending vibration plate 16. The vibrator 18 adheres by an adhesive to the bending vibration plate 16 or is fit in the concave part formed in the bending vibration plate 16. The vibrator 18 can employ a structure of assembling the piezoelectric materials partially, for example, the laminated piezoelectric ceramics and/or the compound piezoelectric ceramics. When the acoustic radiation plate 12, the first coupling member 14, and the second coupling members 52 and 152 is made of an anti-rust material such as plastics and FRP (Fiber Reinforced Plastics), and metal such as stainless steel and titanium, it is possible to use the electro-acoustic transducer 10 directly in a medium without the above mentioned shield member.

Figure 12:
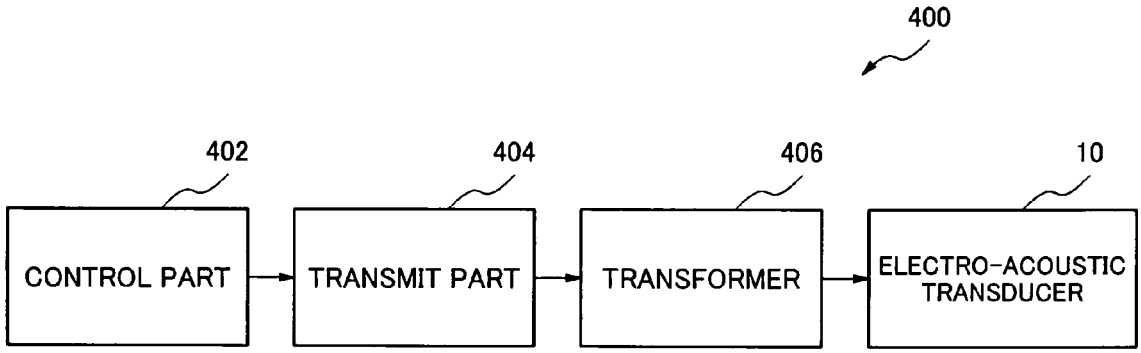
FIG. 12 is a block diagram for controlling a transmitter of sonar into which the electro-acoustic transducer shown in FIG. 1A to 1C is installed.

FIG. 12 is a block diagram of a transmitter 400 of sonar into which the electro-acoustic transducer 10 mentioned above is installed. The transmitter 400 of the sonar includes a control part 402, a transmit part 404, a transformer 406, and the electro-acoustic transducer 10. The control part 402 includes a control circuit having a CPU (Central Processing Unit) and a DSP (Digital Signal Processor), and a storage circuit storing a transmission signal. The control part 402 outputs the transmission signal to the transmit part 404. The transmit part 404 amplifies the transmission signal inputted from the control part 402 and applies it to a primary winding of the transformer 406 as the primary voltage. The vibrator 18 of the electro-acoustic transducer 10 is driven by the secondary voltage generated in the secondary winding of the transformer 406, and then, a sound wave is radiated into a medium such as water. The transmitter 400 of the sonar is installed into a ship and an airplane. The ship and the airplane have limitation in room for containing an apparatus and also in electric power of battery. Since the electro-acoustic transducer 10 is excellent at electro-acoustic conversion efficiency, that is, the power efficiency and, furthermore, is small in size, it is possible to save room for containing the apparatus and the power consumption of the ship and the airplane. The electro-acoustic transducer installed into the transmitter 400 of the above mentioned sonar is not limited to the electro-acoustic transducer 10 and may adopt the various kinds of the electro-acoustic transducers mentioned above. The above mentioned electro-acoustic transducers can be used widely, for example, a speaker in water which is used in a swimming pool, and a sound source for the stratum survey.

The previous description of embodiments is provided to enable a person skilled in the art to make and use the present invention. Moreover, various modifications to these embodiments will be readily apparent to those skilled in the art, and the generic principles and specific examples defined herein may be applied to other embodiments without the use of inventive faculty. Therefore, the present invention is not intended to be limited to the embodiments described herein but is to be accorded the widest scope as defined by the limitations of the claims and equivalents.

Further, it is noted that the inventor's intent is to retain all equivalents of the claimed invention even if the claims are amended during prosecution.

While this invention has been described in connection with certain preferred embodiments, it is to be understood that the subject matter encompassed by way of this invention is not to be limited to those specific embodiments. On the contrary, it is intended for the subject matter of the invention to include all alternative, modification and equivalents as can be included within the spirit and scope of the following claims.

Further, it is the inventor's intention to retain all equivalents of the claimed invention even if the claims are amended during prosecution.

What is claimed is:

1. An electro-acoustic transducer, comprising:

an electro-acoustic transduction unit, the electro-acoustic transduction unit including:

an acoustic radiation plate which radiates a sound wave;

a bending vibration plate including a vibrator;

a first coupling member which couples an edge portion of the acoustic radiation plate with an edge portion of the bending vibration plate together; and a second coupling member which is disposed on a central portion of the bending vibration plate of the electro-acoustic transduction unit, the second coupling member being disposed on an opposite side thereof from the acoustic radiation plate, and wherein a pair of the electro-acoustic transduction units is coupled at the central portion of the bending vibration plate thereof by the second coupling member.

2. The electro-acoustic transducer according to claim 1, wherein a supporting member supports the electro-acoustic transduction unit via the second coupling member.

3. The electro-acoustic transducer according to claim 1, wherein a cavity is formed inside the second coupling member.

4. The electro-acoustic transducer according to claim 3, wherein a concave portion is formed at a position of the bending vibration plate corresponding to the cavity.

5. The electro-acoustic transducer according to claim 1, further comprising:

a second electro-acoustic transduction unit including a pair of the bending vibration plates whose edge portions are coupled to each other by a third coupling member, wherein the second electro-acoustic transduction unit is arranged between a pair of the electro-acoustic transduction units, and the bending vibration plates of the electro-acoustic transduction unit and the second electro-acoustic transduction unit are coupled to each other at the central position thereof by the second coupling member.

6. The electro-acoustic transducer according to claim 1, wherein a gap between the pair of the bending vibration plates are sealed, at the edge portion thereof, by a seal member.

7. The electro-acoustic transducer according to claim 6, wherein the seal member includes a metal plate.

8. The electro-acoustic transducer according to claim 1, wherein the bending vibration plate is capable of vibrating in a high order vibration mode.

9. The electro-acoustic transducer according to claim 1, wherein the acoustic radiation plate includes a vibrator.

10. The electro-acoustic transducer according to claim 9, wherein a resonance frequency of the acoustic radiation plate in a bending vibration mode is substantially equal to a resonance frequency of the bending vibration plate.

11. The electro-acoustic transducer according to claim 1, wherein the bending vibration plate includes the vibrators in both surfaces thereof.

12. The electro-acoustic transducer according to claim 1, wherein the bending vibration plate includes the vibrator in either surface thereof.

13. The electro-acoustic transducer according to claim 1, wherein the first coupling member integrates the acoustic radiation plate.

14. The electro-acoustic transducer according to claim 1, wherein the first coupling member integrates the bending vibration plate.

15. The electro-acoustic transducer according to claim 1, wherein the first coupling member includes a mechanism for restraining a stress concentration.

16. The electro-acoustic transducer according to claim 1, wherein the second coupling member integrates the bending vibration plate.

17. The electro-acoustic transducer according to claim 1, wherein the second coupling member includes a mechanism for restraining a stress concentration.

* * * * *